United States Patent [19]

Johnson

[11] 4,082,496

[45] Apr. 4, 1978

[54] CHAIN SECURED CIGARETTE LIGHTER

[76] Inventor: Manuel J. Johnson, 18442 Pinehurst, Detroit, Mich. 48221

[21] Appl. No.: 699,079

[22] Filed: Jun. 23, 1976

[51] Int. Cl.[2] ..... F23D 13/24

[52] U.S. Cl. ..... 431/343; 24/73 CS; 431/253

[58] Field of Search ..... 431/253, 343, 356; 2/249, 250; 24/3 H, 73 CS

[56] References Cited

U.S. PATENT DOCUMENTS

| | | | |
|---|---|---|---|
| 2,042,808 | 6/1936 | Seebeck | 24/73 CS |
| 2,737,036 | 3/1956 | Simpson | 431/202 X |

FOREIGN PATENT DOCUMENTS

| | | | |
|---|---|---|---|
| 910,045 | 5/1946 | France | 431/253 |
| 13,472 of | 1913 | United Kingdom | 431/253 |

*Primary Examiner*—Edward G. Favors
*Attorney, Agent, or Firm*—Basile and Weintraub

[57] ABSTRACT

Relates to an attachment for cigarette lighters for ensuring against accidental loss or theft while at the same time providing convenient wearing and attractive display. Most cigarette lighters have been carried in independent fashion and are frequently lost or borrowed because of the absence of an attachment to a wearing garment. The present invention provides an attractive chain linkage for securing a cigarette lighter to wearing apparel, and particularly to a vest, which prevents loss of the lighter yet enables the wearer of the vest to have free use of the lighter. The chain is joined at one end to the non-flammable end of the lighter and especially the cap which seals the inlet into the lighter casing for filling the lighter with ignitable fluid. Normally, the lighter with the attached end of the chain would be carried in a vest pocket. The balance of the chain is passed through a button hole of the vest and carries on its other end a weighted object, such as a watch, receivable in a pocket of the vest remote from the lighter. The chain is long enough to enable the wearer of the vest to take out the lighter and without detaching the chain, light a cigarette held in his mouth.

5 Claims, 7 Drawing Figures

CHAIN SECURED CIGARETTE LIGHTER

BACKGROUND OF THE INVENTION

Cigarette lighters have usually been independently carried in pockets and as a result were often inadvertently left on a table by the owner or momentarily loaned to another who thoughtlessly carried it away. No satisfactory way of securement has been conceived for attaching the cigarette lighter to the wearing apparel for avoiding such occurrences and which also provide an attractive apearance and enabled the wearer to use the lighter without the necessity of separating the lighter from its securement of the wearing apparel.

SUMMARY OF THE INVENTION

Accordingly, an important object of the invention is to provide a form of securement for a cigarette lighter which overcomes the aforementioned difficulties and problems.

Another important object of the invention is to provide a securement of this nature for a cigarette lighter which is designed to attach the lighter to the apparel of the person possessing the lighter yet enabling the lighter to be carried within a pocket of the apparel when in non-use and to be taken out of the pocket and used without hindrance to light a cigarette.

In carrying out the objects of the invention, the form of securement for the cigarette lighter is a flexible chain preferably attached at one end to the lighter and having at least a length such as to stretch across the vest and be passed through one of the button holes thereof for deposit in a vest pocket on the other side of the vest. Preferably the opposite end of the chain is connected to an object of a shape and weight comparable to that of the cigarette lighter, such as a pocket watch or a key case. Preferably the chain is of such a length as to enable the person possessing the lighter to raise it from the vest pocket in which it is normally lodged and carry it to his mouth to light a cigarette. Such a length of chain will form neat appearing loops across the front of the vest when the lighter is returned to its pocket.

BRIEF DESCRIPTION OF THE DRAWING

Various other objects, advantages and meritorious features of the invention will become more fully apparent from the accompanying specification, appended claims and accompanying drawing Figures wherein:

DESCRIPTION OF A PREFERRED EMBODIMENT

Figure 1:
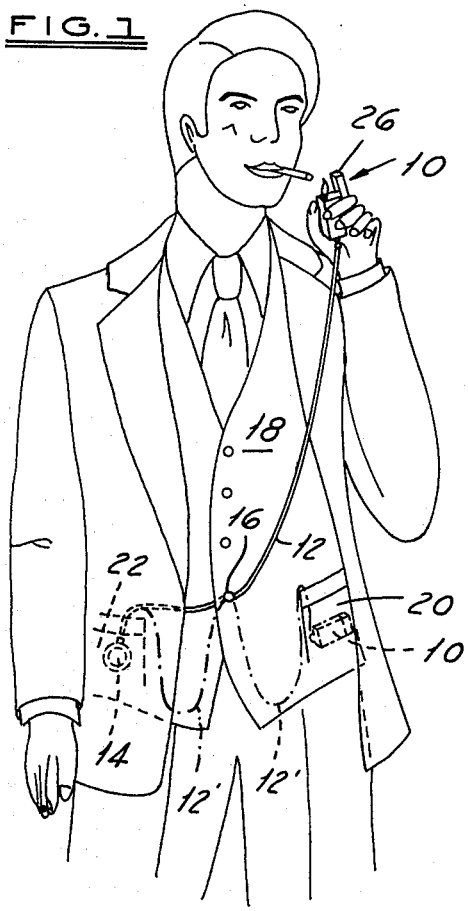
FIG. 1 is an illustration of a person showing by full and dashed lines how a cigarette lighter constructed and assembled with a chain in accordance with this invention may be worn on a vest and used to light cigarettes.

Referring more particularly to the FIGS. of the drawing, FIG. 1 illustrates the purpose and function of the chain and cigarette lighter assembly including the securement of a cigarette lighter 10 to one end of a light-weight flexible chain 12 and the attachment of a watch or other object 14 to the other end of the chain. When properly worn, the intermediate portion of the chain 12 extends through a button hole 16 of a vest 18 worn by the person holding the cigarette lighter 10. The chain 12 is of sufficient length so that a person wearing the chain and connected lighter can raise the latter to the height of his mouth for lighting his cigarettes in the manner shown in FIG. 1. In non-use the cigarette lighter 10 is reposable in one of the pockets 20 of the vest, the watch or other object 14 being contained in another vest pocket 22 preferably on the opposite side of the row of button holes 16 from the lighter. In such non-use position, the chain 12 will droop to form one or more downwardly extending loops 12' overlying the vest 18.

The chain is secured to the cigarette lighter in such a manner as to not interfere with the handling and the operation of the lighter and at the same time to form a connection thereto which is relatively permanent at least for the length of time it takes to use up the amount of fuel contained in the fuel chamber of the lighter. For this purpose, the lighter connected end of the chain 12 is shown secured to the bottom end 24 of the lighter 10. The upper end of the lighter has a conventional hinged cover or flip-top 26 for exposing the flame produced by the lighter and for snuffing out the flame by closing the cover. The lighter also carries an exposed rotatable member 28 extending part way along one corner of the rectangularly-shaped body of the lighter. When the lighter is hand-held as in FIG. 1 the rotatable member can be twirled by the thumb of the hand grasping the lighter body in order to produce sparks to ignite the fuel gas or fuel saturated wick. A large number of makes of cigarette lighters are shaped like that generally illustrated in FIGS. 2-4 although they may differ in details from one another. The invention is especially adaptable to such cigarette lighters although not necessarily limited thereto.

Figure 2:
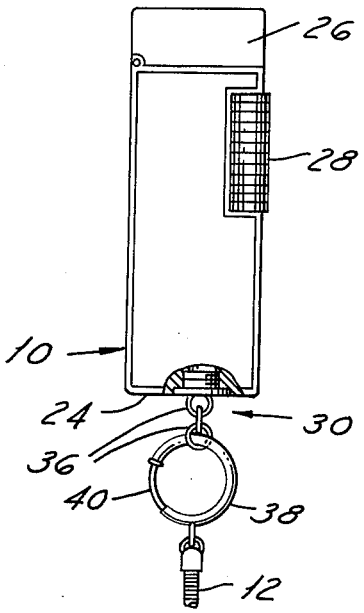
FIG. 2 is an enlarged side elevation of the cigarette lighter, partly broken away in section, and showing a preferred form of attachment of a flexible chain thereto.
Figure 3:
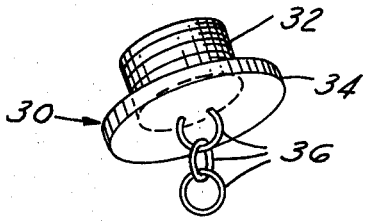
FIG. 3 is a further enlarged perspective view of the filler cap separate and apart from its associated cigarette lighter of FIG. 2 and showing the details of the coupling ring assembly for securing the chain thereto.
Figure 4:
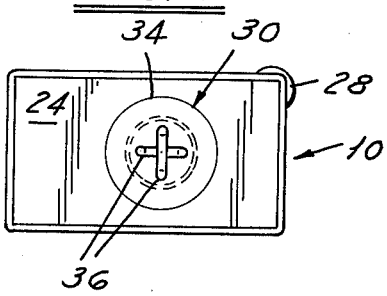
FIG. 4 is a bottom end view of the cigarette lighter shown in FIG. 2.

Many of the aforesaid cigarette lighters have a cap sealed inlet into the fuel chamber of the lighter which may be utilized by the invention for connecting the chain thereto. This is shown in FIGS. 2 and 3 where the cap, which is identified at 30, is composed of a helically threaded shank 32 which in assembled condition with the lighter body is threaded to internal threads surrounding the inlet to the fuel chamber of the lighter. On the outer end of the shank 32 is a disc-shaped member 34 which seats in circular recess of the same diameter formed at the mouth of the inlet to the fuel chamber in the manner shown in FIG. 2. Carried by the disc of the cap member is a series of ring-shaped elements 36 couple one to the other as shown in FIG. 3, the first or innermost one of which is welded, brazed, or otherwise firmly secured to the central area of the disc member 34 of the cap. The outermost link or ring element of the coupled series of ring elements 36 may be directly and permanently secured to the end of the chain selected for securement to the lighter. Preferably, however, it is better to interpose a disconnectible conventional ring-shaped link 38 between the series of ring elements 36 and the selected end of the chain in order to conveniently separate the lighter from the chain. Such disconnectible ring 38 has a movable arcuate section 40 thereof of reduced diameter which is spring biased to the closed position shown but can be slidably moved to an open position to disconnect the ring 38 from the ring element 36 through which it is looped.

The provision of the sequence of ring elements 36 between the screw cover cap 30 and the chain 12 serves to prevent any twisting of the chain, particularly in the direction to unscrew the cap, from being conveyed to the cap with such detrimental results. In other words, the loose set of rings 36 will absorb any such accidental twisting action of the chain and prevent such torque from being applied to the cap.

Figure 5:
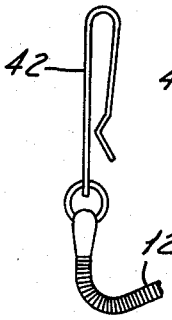
FIGS. 5 and 6 are side and front views respectively of a clasp for securing the end of the chain opposite to the cigarette lighter to the belt for the pair of pants of the person wearing the connected chain and lighter.
Figure 6:
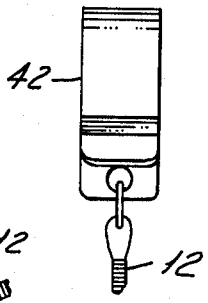

FIGS. 5 and 6 illustrate a modification of the invention where instead of a watch, keycase or other comparable sized object attached to the opposite end of the chain 12 from the lighter 10, the opposite end is joined to a connector or clip 42 shaped to be slidably clipped upon a pant's belt or the like for securement thereto rather than simply repose in an easily withdrawble condition in a vest pocket. If desired, the inner or concealed side of a vest pocket could be provided with a slitted opening for passing the chain and clip 42 through the pocket for attachment to the belt of the wearer.

Figure 7:
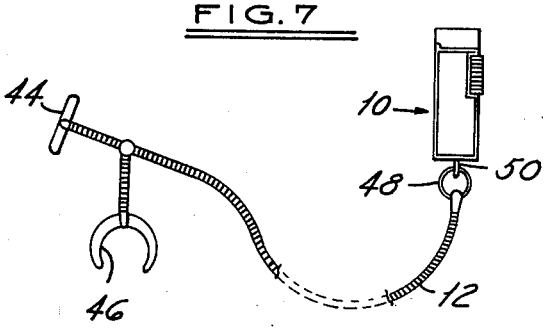
FIG. 7 is a further view of a chain and lighter assembly incorporating features of the invention and showing the connection of the opposite end of the chain from the lighter to one or more ornamental pendants and to a provision for anchoring the end of the chain in a vest pocket.

FIG. 7 illustrates another use of the chain and cigarette lighter assembly where the end of the chain opposite to the lighter carries a transverse cylindrical bar 44 of a size to lie horizontally at the bottom of a vest pocket and serve as an anchor. Near that end of the chain an amulet 46 or one or more ornamental pendants may be suspended from the chain in exposed relation to the vest. In FIG. 7, the chain 12 is shown connected by two rings 48 and 50 to the bottom end of the lighter casing and such a form of connection is satisfactory when direct connection to the fuel inlet cap is avoided.

The chain 12 itself may be composed of any suitable flexible material. It may be formed of connected links of various loop configurations or a single elongated helically coiled member. Usually, metal is preferred for the material of the chain, such as gold or silver for the more expensive chains or inexpensive metal coated with gold or silver for the less costly variety. Depending on the length of the chain, it may be worn in various ways. A long chain of approximately 21 inches is illustrated in FIG. 1 where sufficient slackness will enable the chain to drape two loops over the vest. For shorter lengths, a single loop may be obtained. A still shorter 13 inch chain will extend almost staight across the vest from right to left pocket with little if any slack for passage through a button hole.

It is apparent from the preceding description and accompanying drawing figures that a distinctive provision for attaching a cigarette lighter to apparel has been devised which enables unimpeded usage of the lighter for igniting purposes while at the same time securing it by a chain to a vest or like apparel. The lighter and chain are so connected that the latter does not interfere with the dexterous manipulation of the former and yet serves to secure the lighter to wearing apparel against accidental loss or theft. The chain is of such a length as to enable the lighter to reach the mouth of the wearer and when not so used to drape the vest in a pleasing manner. When the chain is attached to the screw cap for the fuel inlet to the lighter, provision is incorporated into the chain length for preventing any twisting movements of the chain from unscrewing the cap and allowing the igniting fluid to leak out. All these provisions and their respective functions contribute to a highly useful and decorative assemblage for wearing apparel.

While particular embodiments of the invention have been shown and discussed, it will be understood, of course, that it is not desired that the invention be limited thereto since modifications may be made. It is, therefore, contemplated by the appended claims to cover any such modifications as fall within the true spirit and scope of the invention.

What is claimed is:

1. In combination, a cigarette lighter of a size to fit within a pocket of a vest and having a cover normally enclosing the flame area of the lighter, a flexible chain connected at one end to a part of the lighter remote from the cover and provided at the other end with means for attachment to an object of a size to fit within a pocket of a vest, said chain having a length such that after being passed through one of the bottom holes of the vest and with the object attaching end reposing in a pocket of the vest the opposite lighter attached end of the chain may be extended to a position adjacent to the mouth of the wearer of the vest where the lighter may be used to light a cigarette held in the mouth of the wearer; and wherein the cigarette lighter has a fuel inlet into the lighter located remote from the flame area enclosing cover and sealed by a removable cap, and wherein the cigarette lighter attached end of the chain is connected directly to the removable cap for the fuel inlet of the lighter.

2. The combination as set forth in claim 1 wherein the cigarette lighter is elongated in one dimension and such that the flame area enclosing cover is located at one end of the elongated lighter and the fuel inlet and its cap is located at the opposite end of the lighter.

3. The combination as set forth in claim 2 wherein the cap is threadedly engaged in the fuel inlet of the cigarette lighter and is removable therefrom by rotation in one direction, and wherein the chain is provided with means for absorbing any twisting action of the chain which would tend to unscrew the cap from the fuel inlet.

4. A cigarette lighter and chain securement assembly therefor comprising, in combination:

a cigarette lighter having a body of a general rectangular configuration and of a size to be grasped by the hand and manipulated by the thumb or other finger for producing a flame for lighting a cigarette or the like, said body having the flame producing area located at its upper end when hand held and normally closed by a cover member except when the lighter is in operation, said lighter body further having a fuel chamber and a fuel inlet thereinto which opens out of the opposite end of the body and is normally sealed by a cap except when the lighter is being fueled;

a flexible chain secured at one end to the fuel inlet end of the lighter body and having means on the other end of the chain for attachment to an object, said cigarette lighter body and said object to be attached to the end of the chain, each being of a size to be received at the same time in different pockets of a vest-like garment while connected together by the chain, said chain being of a length such that the cigarette lighter can be withdrawn from its pocket and raised together with the chain portion attached thereto to a position adjacent to the mouth of the person wearing the garment for lighting a cigarette held in his mouth; and wherein the cigarette lighter attached end of the chain is secured directly to the fuel inlet cap of the lighter body.

5. The cigarette lighter and chain securement assembly set forth in claim 4 wherein the cap is threadedly engaged in the fuel inlet of the lighter body and is removable therefrom by rotation in one direction, and wherein the chain is provided with means absorbing any twisting action to which the chain might be subjected which would tend to unscrew the cap from the fuel inlet.

* * * * *